US009882301B1

(12) United States Patent
Emaci et al.

(10) Patent No.: US 9,882,301 B1
(45) **Date of Patent: *Jan. 30, 2018**

(54) CURRENT RESTRICTIVE SPRING-LOADED ELECTRICAL CONNECTION DEVICE

(71) Applicant: GENERAL ELECTRIC COMPANY, Schenectady, NY (US)

(72) Inventors: Edward Emaci, West Milwaukee, WI (US); Steven Thiel, West Milwaukee, WI (US); Richard Roffers, West Milwaukee, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/589,992

(22) Filed: May 8, 2017

Related U.S. Application Data

(63) Continuation-in-part of application No. 15/281,750, filed on Sep. 30, 2016, now Pat. No. 9,647,367.

(51) Int. Cl.

| | |
|---|---|
| ***H01R 13/24*** | (2006.01) |
| ***H05G 1/70*** | (2006.01) |
| *H01R 13/03* | (2006.01) |
| *H01R 4/60* | (2006.01) |
| *H01R 12/57* | (2011.01) |
| *H01R 12/50* | (2011.01) |
| *H01R 11/18* | (2006.01) |

(52) U.S. Cl.
CPC ..... *H01R 13/2421* (2013.01); *H05G 1/70* (2013.01); *H01R 4/60* (2013.01); *H01R 11/18* (2013.01); *H01R 12/57* (2013.01); *H01R 13/03* (2013.01); *H01R 23/722* (2013.01)

(58) Field of Classification Search
CPC .. H01R 13/2421; H01R 23/722; H01R 11/18; H01R 12/57
USPC ..... 439/700, 66, 824, 83
See application file for complete search history.

(56) References Cited

U.S. PATENT DOCUMENTS

| | | | | |
|---|---|---|---|---|
| 5,388,997 | A * | 2/1995 | Grange | H01R 13/2421 347/50 |
| 5,417,595 | A * | 5/1995 | Cullen | H01R 13/2421 439/700 |
| 7,094,112 | B2 * | 8/2006 | Arai | H01R 13/187 439/482 |
| 9,350,104 | B1 * | 5/2016 | Chen | H01R 12/716 |
| 2005/0026510 | A1 * | 2/2005 | Orihara | H01R 13/2421 439/700 |

* cited by examiner

*Primary Examiner* — Phuong Chi T Nguyen

(57) ABSTRACT

A connector pin assembly configured to engage an electrical interface. The connector pin assembly comprises a conductive outer cylinder configured to be connected to a power supply that supplies current or voltage; a conductive inner cylinder located at least partially within the outer cylinder; and a biasing member disposed within the inner cylinder. The connector pin assembly further comprises a conductive plunger slidably disposed within and engaged with the inner cylinder and the biasing member; a non-conductive member disposed within the inner cylinder, the non-conductive member operable to restrict a current or voltage flowing through the connector pin along a path from the outer cylinder through the inner cylinder to the plunger without contacting the biasing member.

20 Claims, 8 Drawing Sheets

CURRENT RESTRICTIVE SPRING-LOADED ELECTRICAL CONNECTION DEVICE

CROSS-REFERENCE TO RELATED APPLICATIONS

This application is a continuation-in-part of U.S. patent application Ser. No. 15/281,750, filed Sep. 30, 2016, issuing as U.S. Pat. No. 9,647,367 on May 9, 2017, the contents of which are incorporated herein by reference.

BACKGROUND

The subject matter disclosed herein relates generally to diagnostic imaging and, more particularly, to an electrical inter-connect device for connection of electrical components within x-ray tubes and a method of manufacturing same.

Presently available medical x-ray tube designs typically include an insert assembly that houses a cathode assembly having an emitter or filament and a cathode cup and an anode assembly. The cathode assembly is oriented to face an x-ray tube anode assembly, or target, which is typically a planar metal or composite structure. The space within the x-ray tube between the cathode and anode is evacuated.

X-ray tubes typically include an electron source, such as a cathode, that releases electrons at high acceleration. Some of the released electrons may impact a anode target. The collision of the electrons with the anode target produces x-rays, which may be used in a variety of medical devices such as computed tomography (CT) imaging systems, x-ray scanners, and so forth.

To emit the electrons, the cathode assembly typically is operated at high voltage and includes a filament or electron emitter that requires current to be run through it to in order to produce the electrons as part of a process whereby the x-rays are generated after electrons hit the anode at a lower or zero high voltage potential. To supply current to the cathode assembly operated at high voltage, current x-ray tube designs also include a voltage connector assembly that is typically attached mechanically and electrically to the cathode assembly.

The electrical connection between the cathode assembly and the connector assembly provides a path for conducting current between the connector and the cathode assembly, and directs that current along the path provided to the filament or emitter to generate electrons. As shown in FIG. 1A, the electrical connection utilized with prior art x-ray tube designs includes an inter-connect/connector pin 1000 on the connector that allows the transfer of current between the connector and cathode assembly. The pin 1000 includes an outer housing or cylinder 1002 engaged with the connector and an inner housing or cylinder 1004 disposed co-axially within the outer cylinder 1002. The inner cylinder 1004 houses a spring 1006 that is compressed between an end of the inner cylinder 1004 and a ball 1008. The ball 1008 is pressed by the spring 1006 against a plunger 1010 that is slidably mounted within the inner cylinder 1004. The plunger 1010 terminates in an engagement structure or hat 1012 that is pressed against a contact terminal (not shown) located on an insulator of the cathode assembly in order to create the electrical connection and current path between the connector and the cathode assembly.

The plunger 1010 is formed with a head 1014 located adjacent the ball 1008. The head 1014 includes a sloped surface 1016 that engages the ball 1008. The orientation of the sloped surface 1016 allows the force exerted by the spring 1006 on the head 1014 through the ball 1008 to urge the plunger 1010 axially out of the inner cylinder 1004 and radially into contact with the inner cylinder 1004. By urging the head 1014 of the plunger 1010 into contact with the inner cylinder 1004, when the current is directed through the pin 1000 to the cathode assembly, the path taken by the current goes from the outer cylinder 1002 to the inner cylinder 1004 at a point near the head 1014, then from the inner cylinder 1004 to the plunger 1010 via the head 1014, and finally from along the plunger 1010 to the hat 1012 for transmission to the contact point on the cathode assembly.

In these prior art connectors, to avoid the use of a blind, tight-tolerance connection between a socket or bore (not shown) in the cathode assembly and the pin 1000, which could easily result in damage to the pin 10, the construction of the pin 1000 is designed to allow the connector to "float" with respect to the cathode assembly. Thus, the hat 1012 is not engaged within a bore but is pressed against a contact point on the surface of the cathode assembly within a tolerance of 1-2 mm that still provides the necessary electrical connection between the connector and the cathode assembly.

However, as a result of slight forces exerted on the hat 1012 and plunger 1010 during installation and/or use of the imaging device including the connector, the plunger 1010 can be shifted radially within the inner cylinder 1004. This shift moves the head 1014 out of contact with the inner cylinder 1004 and creates a different current path through the pin 1000. As shown in FIG. 1B, in this situation the current flows from the outer cylinder 1002 to the inner cylinder 1004, from the inner cylinder 1004 through the spring 1006, from the spring 1006 to the ball 1008, and finally from the ball 1008 to the head 1014 of the plunger 1010. This alternative current path results in significant heating of the spring 1006, which consequently anneals the spring 1006 and causes it to lose its biasing capability. As a result, with no spring bias or force to create contact between the ball 1008 and the plunger 1010, and consequently between the hat 1012 and the contact point on the insulator, the x-ray tube is rendered incapable of generating x-rays, such that the connector and/or the defective pin 1000 must be removed and replaced, resulting is significant downtime for the imaging device.

Hence, it is desirable to provide a connector including a pin construction that can significantly reduce the transmission of current through pin along the main failure current path through the spring, thereby increasing the useful life of the connector, reducing downtime at hospitals due to failed x-ray tubes and the need for x-ray tube replacement.

BRIEF DESCRIPTION

The above-mentioned drawbacks and needs are addressed by the embodiments described herein in the following description. In the various embodiments of invention, a connector pin for a connector (the connector could be a high voltage (hv) connector or non-high voltage connector) is formed with a non-conductive element or member disposed within the pin. The non-conductive element forms an electrical block to overcome the inherent capability of the pin to allow current to flow in multiple directions within the device by preventing or restricting alternative current paths through the pin, thereby avoiding annealing of the spring to maintain the bias of the spring and extend the life of the connector.

One non-limiting embodiment of this disclosure is a connector pin assembly for a connector for an x-ray tube, the connector pin assembly including a conductive outer cylinder configured to be connected to a power supply (i.e. a high voltage or non-high voltage power supply), a conductive inner cylinder located at least partially within the outer cylinder, a biasing member disposed within the inner cylinder, a conductive plunger slidably disposed within and engaged with the inner cylinder and the biasing member and a non-conductive member disposed within the inner cylinder, the non-conductive member operable to restrict a current or voltage flowing through the connector pin along a path from the outer cylinder through the inner cylinder to the plunger without contacting the biasing member.

Another non-limiting embodiment of this disclosure is a method for supplying current to a cathode assembly of an x-ray tube, the method including the steps of providing a connector having a housing defining an interior, a cup positioned within the interior of the housing and including an open end and a number of connector pins disposed within the cup and configured to be connected to a power supply, wherein each pin includes a conductive outer cylinder configured to be connected to the power supply, a conductive inner cylinder located at least partially within the outer cylinder, a biasing member disposed within the inner cylinder, a conductive plunger slidably disposed within and engaged with the inner cylinder and the biasing member, and a non-conductive member disposed within the inner cylinder, the non-conductive member operable to restrict a current flowing through the connector pin along a path from the outer cylinder through the inner cylinder to the plunger, connecting the connector to the cathode assembly and passing a current or voltage through the connector to the cathode assembly to generate an electron beam or path.

Another non-limiting embodiment of this disclosure is a connector including a housing defining an interior, a cup positioned within the interior of the housing and including an open end and a number of connector pins disposed within the cup and configured to be connected to a power supply, wherein each pin includes a conductive outer cylinder configured to be connected to the power supply, a conductive inner cylinder located at least partially within the outer cylinder, a biasing member disposed within the inner cylinder, a conductive plunger slidably disposed within and engaged with the inner cylinder and the biasing member and a non-conductive member disposed within the inner cylinder, the non-conductive member operable to restrict a current or voltage flowing through the connector pin along a path from the outer cylinder through the inner cylinder to the plunger without contacting the biasing member.

Another non-limiting embodiment of this disclosure provides a connector pin assembly configured to engage an electrical interface. The connector pin assembly comprises a conductive outer cylinder configured to be connected to a power supply that supplies current or voltage; a conductive inner cylinder located at least partially within the outer cylinder; and a biasing member disposed within the inner cylinder. The connector pin assembly further comprises a conductive plunger slidably disposed within and engaged with the inner cylinder and the biasing member; a non-conductive member disposed within the inner cylinder, the non-conductive member operable to restrict a current or voltage flowing through the connector pin along a path from the outer cylinder through the inner cylinder to the plunger without contacting the biasing member. In at least one embodiment, the assembly includes a pin housing or pin support region defining an opening to enable engagement with the electrical interface.

Another non-limiting embodiment of this disclosure provides a connector device configured to be engaged with a mating assembly of an electrical interface. The connector device comprises a housing defining an interior; and a pin housing or pin support region positioned within the interior of the housing. The pin housing or pin support region comprises a number of connector pins disposed therein and configured to be connected to a power supply. Each connector pin comprises a conductive outer cylinder configured to be connected to the power supply, a conductive inner cylinder located at least partially within the outer cylinder, a biasing member disposed within the inner cylinder, a conductive plunger slidably disposed within and engaged with the inner cylinder and the biasing member, and a non-conductive member disposed within the inner cylinder, the non-conductive member operable to restrict a current or voltage flowing through the connector pin along a path from the outer cylinder through the inner cylinder to the plunger without contacting the biasing member.

Another non-limiting embodiment of this disclosure provides a method for supplying current or voltage from a connector to a mating assembly of an electrical interface. The method comprises the step of providing a connector having a housing defining an interior, a pin housing or pin support region positioned within the interior of the housing and comprising a number of connector pins disposed therein and configured to be connected to a power supply, wherein each pin comprises a conductive outer cylinder configured to be connected to the power supply, a conductive inner cylinder located at least partially within the outer cylinder, a biasing member disposed within the inner cylinder, a conductive plunger slidably disposed within and engaged with the inner cylinder and the biasing member, and a non-conductive member disposed within the inner cylinder, the non-conductive member operable to restrict a current or voltage flowing through the connector pin along a path from the outer cylinder through the inner cylinder to the plunger. Further, the method comprises connecting the connector to the mating assembly of the electrical interface, and passing a current or voltage through the connector to the mating assembly of the electrical interface to generate an electron path.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure

BRIEF DESCRIPTION OF THE DRAWINGS

The drawings illustrate the best mode presently contemplated of carrying out the disclosure. In the drawings.

DETAILED DESCRIPTION

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

The exemplary non-limiting embodiments described herein relate to a connector or connector pin assembly configured to couple or connect to an electrical interface, or a mating assembly of an electrical interface, of any device to provide or pass a current or voltage to the device or at least one component of the device. As an illustrative example, the device is an x-ray tube and the component is a cathode of the x-ray tube; this example, however, should not be construed as a limitation, as the device can be any device, or component of the device, that receives a current or voltage to operate or function. The connector, which could be a high voltage (hv) connector or non-high voltage connector (i.e. the amount of voltage should not be construed as a limitation) includes a number of inter-connect pins that engage contact points on an electrical interface or mating assembly of an electrical interface to supply current or voltage to a device such as, for example, a cathode assembly.

Figure 2:
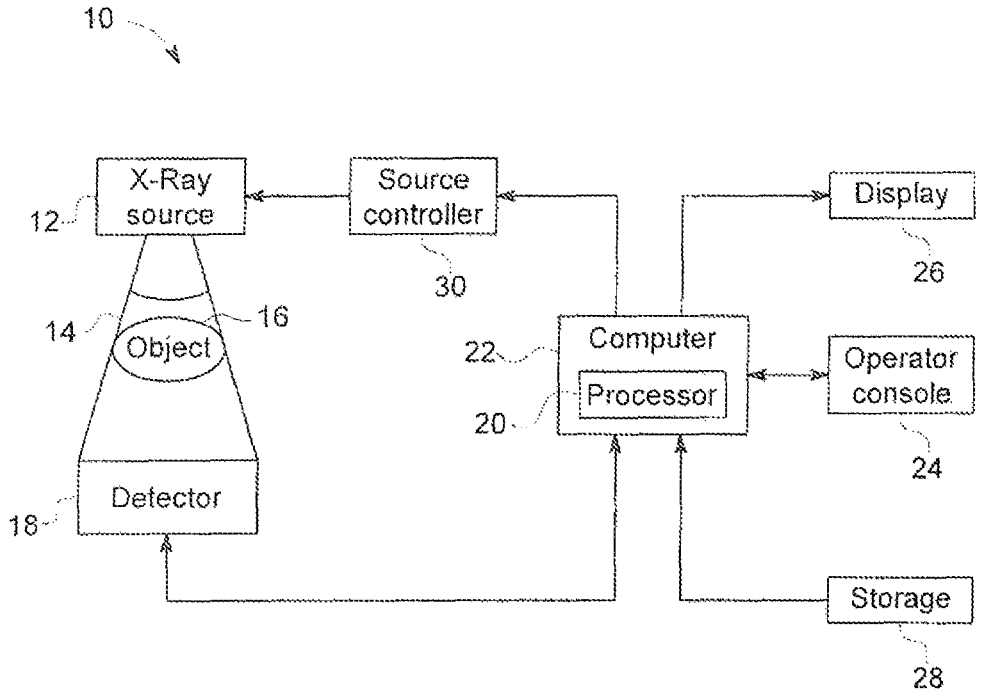
FIG. 2 is a block diagram of an imaging system according to an exemplary embodiment of the invention.

FIG. 2 is a block diagram of an embodiment of an imaging system 10 designed both to acquire original image data and to process the image data for display and/or analysis in accordance with embodiments of the invention. It will be appreciated by those skilled in the art that embodiments of the invention are applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from embodiments of the invention. The following discussion of x-ray system 10 is merely an example of one such implementation and is not intended to be limiting in terms of modality.

As shown in FIG. 2, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, flash memory, compact discs, etc. The operator may also use console 24 to provide commands and instructions to computer 22 for controlling a source controller 30 that provides power and timing signals to x-ray source 12.

Figure 3:
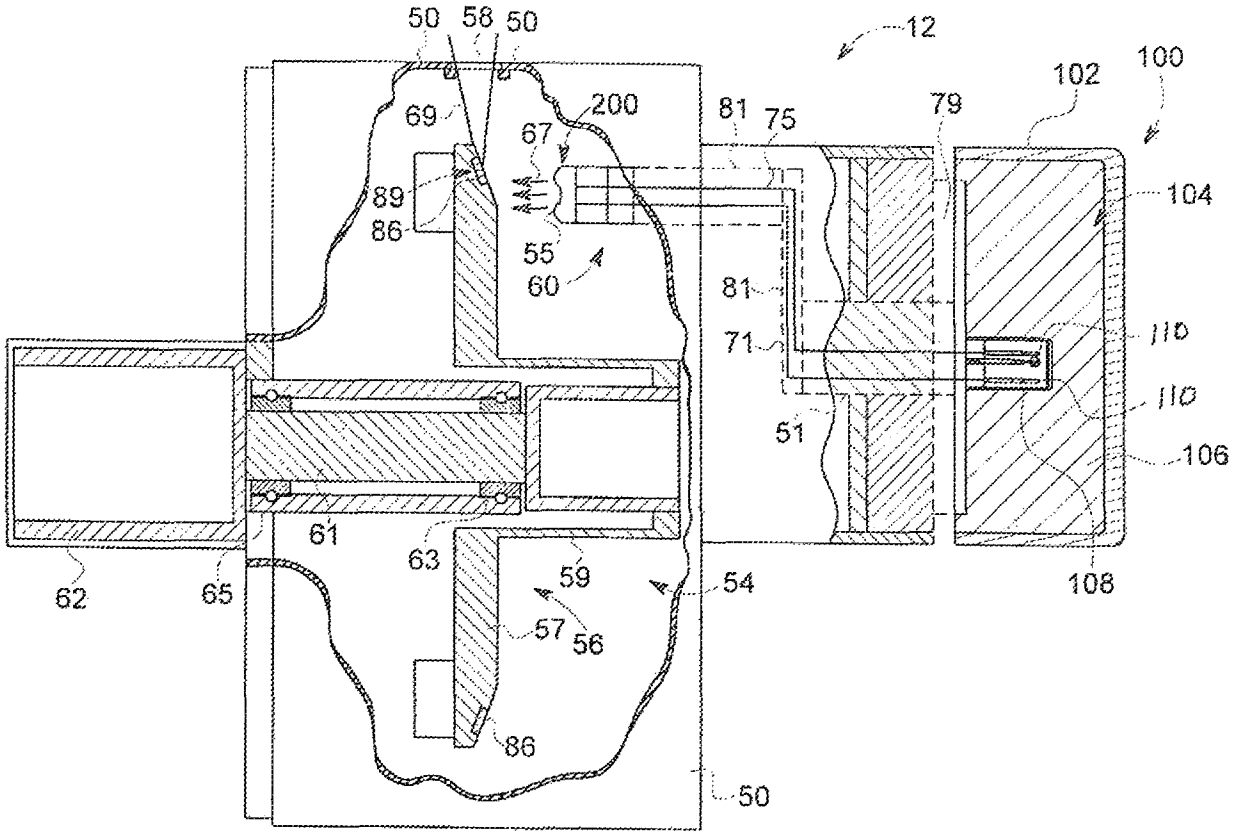
FIG. 3 is a cross-sectional view of an x-ray tube/source according to an exemplary embodiment of the invention.
Figure 4:
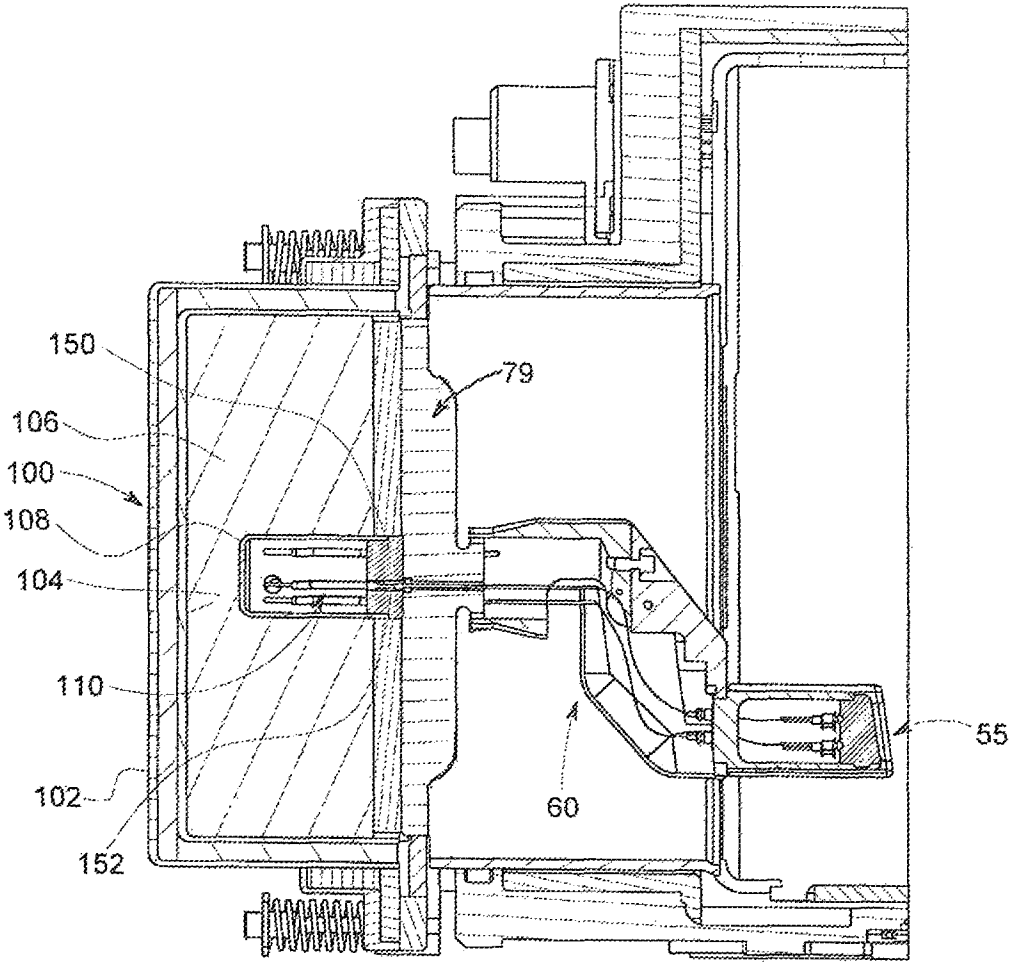
FIG. 4 is a partially broken away cross-sectional view of a connector and electrical assembly according to one exemplary embodiment of the invention.
Figure 5:
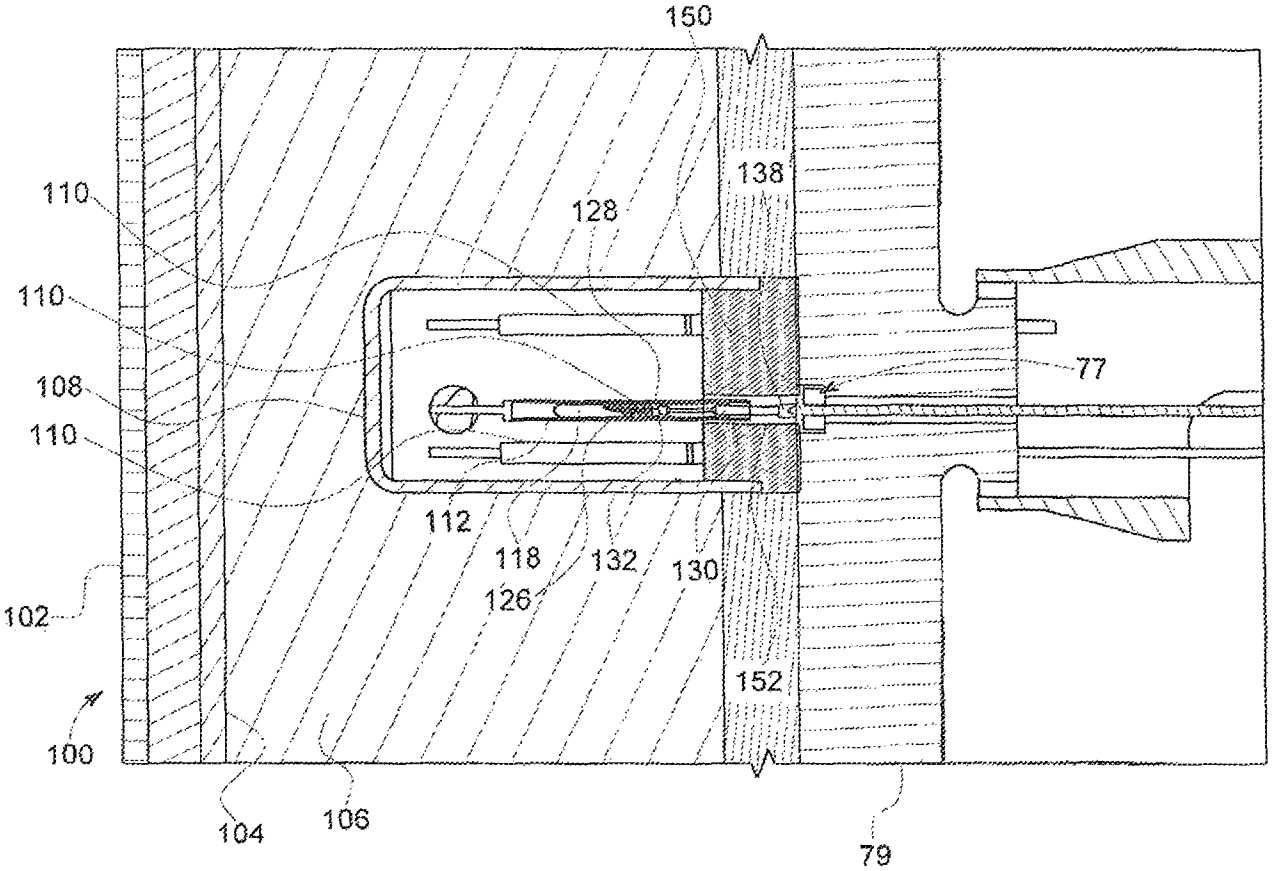
FIG. 5 is circular sectional view along line 5-5 of FIG. 4.

FIG. 3 illustrates a cross-sectional view of an x-ray tube 12 incorporating embodiments of the invention. X-ray tube 12 includes a frame 50 that encloses a vacuum region 54, and an anode 56 and a cathode assembly 60 are positioned therein. Anode 56 includes a target 57 having a target track 86, and a target hub 59 attached thereto. Terms "anode" and "target" are to be distinguished from one another, where target typically includes a location, such as a focal spot, wherein electrons impact a refractory metal with high energy in order to generate x-rays, and the term anode typically refers to an aspect of an electrical circuit which may cause acceleration of electrons theretoward. Target 56 is attached to a shaft 61 supported by a front bearing 63 and a rear bearing 65. Shaft 61 is attached to a rotor 62. Cathode assembly 60 includes a cathode cup 200 and an emitter or filament 55 formed of any suitable emissive material and coupled to a current or voltage supply lead 71 and a current or voltage return 75 that each pass through a center post 51. In operation, electrical current is carried to the filament or flat emitter 55 via the current supply lead 71 and from flat emitter 55 via the current return 75 which are electrically connected to source controller 30 and controlled by computer 22 of system 10 in FIG. 2.

Electrical leads 71 and 75 are electrically connected to contact points 77 that pass through an insulator 79. X-ray tube 12 includes a window 58 typically made of a low atomic number metal, such as beryllium, to allow passage of x-rays therethrough with minimum attenuation. Cathode assembly 60 includes a support arm 81 that supports cathode cup 200, emitter 55, as well as other components thereof. Support arm 81 also provides a passage for leads 71 and 75. Cathode assembly 60 may have focus pads (not shown) that are either attached to cathode cup 200 or machined into cathode cup 200. The cathode assembly 60 includes width and length electrodes (not shown) arranged around the emitter 55 on the cup 200 and can be electrically isolated and operated to provide a focusing field around the emitter 55 to focus the beams of electrons 67 from the emitter 55 in a range from small to large focal spots.

In operation, target 56 is spun via a stator (not shown) external to rotor 62. An electric current or voltage is applied to flat emitter 55 via contact points 77 to heat emitter 55 and emit electrons 67 therefrom. A high-voltage electric potential is applied between anode 56 and cathode 60, and the difference therebetween accelerates the emitted electrons 67 from cathode 60 to anode 56. Electrons 67 impinge target 57 at target track 86 and x-rays 69 emit therefrom at a focal spot 89 and pass through window 58.

Referring now to FIGS. 4-6E, a connector 100 constructed to one exemplary non-limiting embodiment of the present disclosure is illustrated therein. The connector 100 is disposed against and secured to the insulator 79 of the cathode assembly 60 in order to connect the power supply (not shown) to the cathode assembly 60. The connector 100 includes a housing 102 that can be secured to the insulator 79/cathode assembly 60 in a suitable manner and that defines an interior 104 therein. In at least one embodiment, the interior 104 of the housing 102 is optionally filled with an insulating material 106, and includes a pin housing or pin support region 108 disposed or located therein. The pin housing or pin support region 108 is axially aligned with the housing 102 and is connected via a conduit or cable (not shown) to the exterior of the connector 100 in order to enable electric supply wires (not shown) to be run from the power supply through the conduit and into the pin housing or pin support region 108. In at least one embodiment, the pin housing or pin support region 108 comprises (or is comprised of) a faraday cup or enclosure.

Within the pin housing or pin support region 108, the wires are connected to a number of connector pins 110 located within the pin housing or pin support region 108. The pins 110 are formed similarly to the prior art pins 1000 and each include an outer housing or cylinder 112 formed of a conductive material, such as a metal, that is fixed within the pin housing or pin support region 108, such as by an epoxy (not shown) that fills the space in the pin housing or pin support region 108 between the pin housing or pin support region 108 and the pins 110. The outer cylinder 112 also includes a radial ridge 114 that defines a space for receiving a detent 116 formed on an inner housing or cylinder 118. The inner cylinder 118 is formed of a conductive material, such as a metal, and is inserted and disposed co-axially within the outer cylinder 112 by pressing the inner cylinder 118 into the outer cylinder 112 until the detent 116 on inner cylinder 118 is seated within the ridge 114 on outer cylinder 112 to properly locate or position the inner cylinder 118 within the outer cylinder 112.

The inner cylinder 118 has a closed end 120 disposed within the outer cylinder 112 and an open end 122 aligned with an open end 124 of the outer cylinder 112. The inner cylinder 118 has a biasing member such as a spring 126 that is located within the interior of the inner cylinder 118. The spring 126 can be formed of a conductive or non-conductive material and is compressed between the closed end 120 of the inner cylinder 118 and a ball 128. The ball 128 is formed of a conductive or non-conductive material and is pressed by the spring 126 against a plunger 130 that is slidably mounted within the inner cylinder 118.

The plunger 130 is formed of a conductive material, such as a metal, and includes a head 132 disposed adjacent the ball 128, a narrow shaft 134 extending away from the head 132, a wide shaft 136 extending away from the narrow shaft 134, and an engagement structure or hat 138 located on the wide shaft 136 opposite the narrow shaft 134. The head 132 is formed with a diameter that is greater than the diameter of a stop 140 formed on the inner cylinder 118 in order to limit the range of motion of the plunger 130 with regard to the inner cylinder 118 and to retain the head 132, ball 128 and spring 126 within the inner cylinder 118.

In at least one embodiment, the pin housing or pin support region 108 is enclosed by a cap 150 that is fixed over the pin housing or pin support region 108 and including apertures 152 though which plunger 130 extends. The apertures 152 have a diameter greater than the diameter of the plunger 130 so as not to interfere with the movement of the plungers 130. It should be noted that the cap 50 is not an absolute requirement and can be eliminated if desired.

The head 132 also includes a sloped lower surface 142 adjacent the ball 128. The sloped surface 142 creates an angle for the contact point of the ball 128 with the head 132 that enables the spring 126 via the ball 128 to provide an axial force on the head 132 to move the plunger 130 axially with respect to the inner cylinder 118 and a radial force to urge the head 132 into contact with the inner cylinder 118. These forces applied by the spring 126 on the plunger 130 enable the plunger 130 to be maintained in contact with the inner cylinder 118 and with the contact point 77 on the insulator 79. As a result, when current or voltage is supplied to the pin 110, these forces enable the current to travel along a path from the outer cylinder 112 connected to the supply wire (not shown) to the inner cylinder 118, from the inner cylinder 118 to the plunger 130 and from the plunger 130 to the contact point 77. The plunger 130, and in particular the hat 138 is maintained in engagement with the contact point 77 by the bias of the spring 126 to enable a constant flow of current or voltage from the power supply through the connector 100 and to the cathode assembly 60.

To facilitate the connection of the connector 100 to the cathode assembly 60, the pins 110 are constructed to allow the plungers 130 to "float" with respect to the contact points 77 on the cathode assembly 60. Thus, the hat 138 on the plunger 130 can move or shift against a contact point 77 on the insulator 79 of the cathode assembly 60 within a specified tolerance, which in an exemplary embodiment can be a tolerance of 1-2 mm. This "floating" of the plungers 130 allows the contact points 77 to be formed as flat surfaces or areas on the insulator 79, and not as bores or sockets (not shown) that would require precise insertion of the plungers 130 for an accurate connection and can often result in bending or other types of damage being done to the plungers 130 and/or pins 110.

Figure 1A:
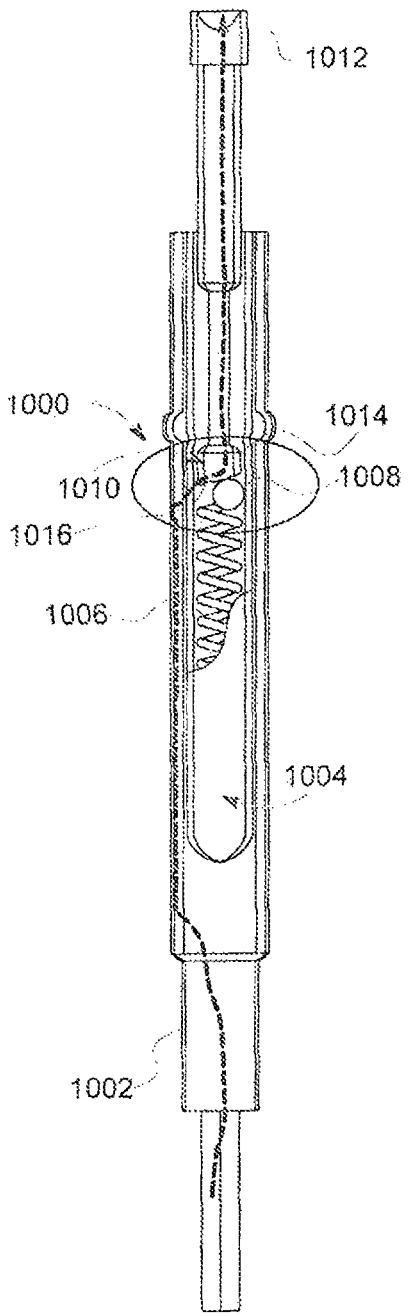
FIG. 1A PRIOR ART
FIG. 1A is a cross-sectional view of a prior art connection pin illustrating a correct current path.
Figure 1B:
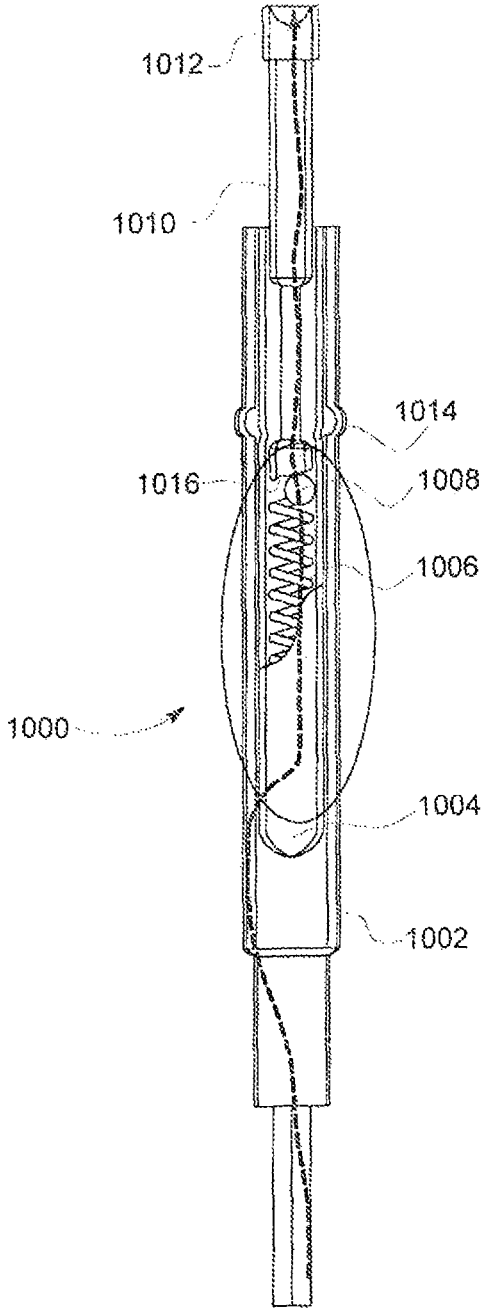
FIG. 1B PRIOR ART
FIG. 1B is a cross-sectional view of a prior art connection pin illustrating an incorrect current path.

However, while still facilitating the necessary electrical connection between the pins 110 on the connector 100 and the contact points 77 on the cathode assembly 60, in order to prevent the shifting of the plunger 130 from creating the undesirable or incorrect current or voltage path as in prior art connector pins 1000, the pins 110 of the connector 100 each include a non-conductive component 144 therein. The non-conductive component 144 is formed of any suitable non-conductive material, such as a solid material, including but not limited to a ceramic or plastic material, or a non-conductive coating, and is positioned within the pin 110 such that the alternative/incorrect current path shown in FIG. 1B is effectively blocked, ensuring that current is restricted to flow along the correct/desired path as shown in FIG. 1A.

Figure 6A:
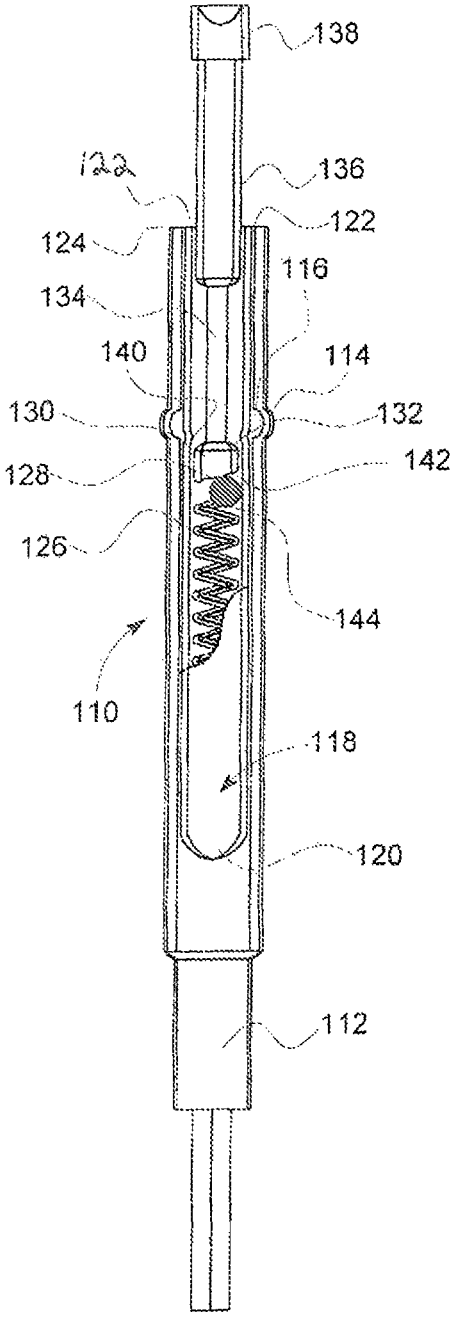
FIGS. 6A-6E are cross-sectional views of various connector pin constructions according to exemplary embodiments of the invention used in the connector of FIG. 4.

Referring now to FIGS. 6A-6E, while the non-conductive component 144 can take a variety of forms or be disposed in a variety of locations within the pin 110 to perform the desired function, in the exemplary and non-limiting embodiment shown in FIG. 6A, the pin 110 is formed with the one or both of the spring 126 and ball 128 being formed of a non-conductive material, such as a plastic or ceramic material, among other suitable materials. The formation of the spring 126 and/or ball 128 from a non-conductive material effectively prevents or restricts current or voltage from passing through the spring 126 and/or ball 128, maintaining the correct current path of FIG. 1A even when the plunger 130 is shifted in position relative to the inner cylinder 118.

Figure 6B:
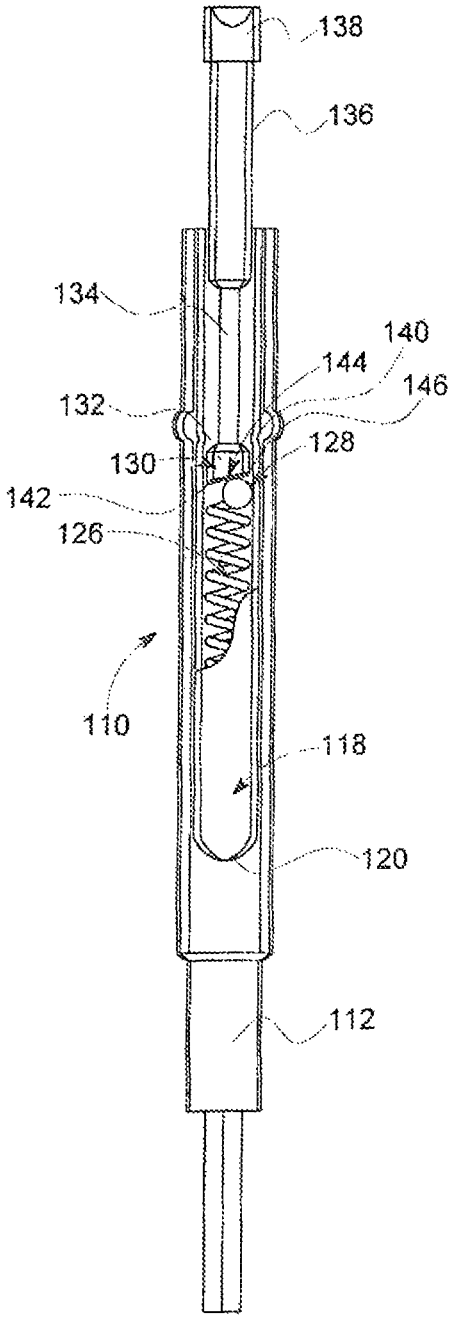

Additionally, with regard to the exemplary and non-limiting embodiment of FIG. 6B, the non-conductive component 144 is formed as a plate member or interface 146 disposed on the sloped surface 142 of the head 132 of plunger 130. The interface 146 can be formed with any desired shape and can include a diameter similar to or larger than the diameter of the head 132 in or to facilitate the engagement of the interface 146 and head 132 with the stop 140.

Figure 6C:
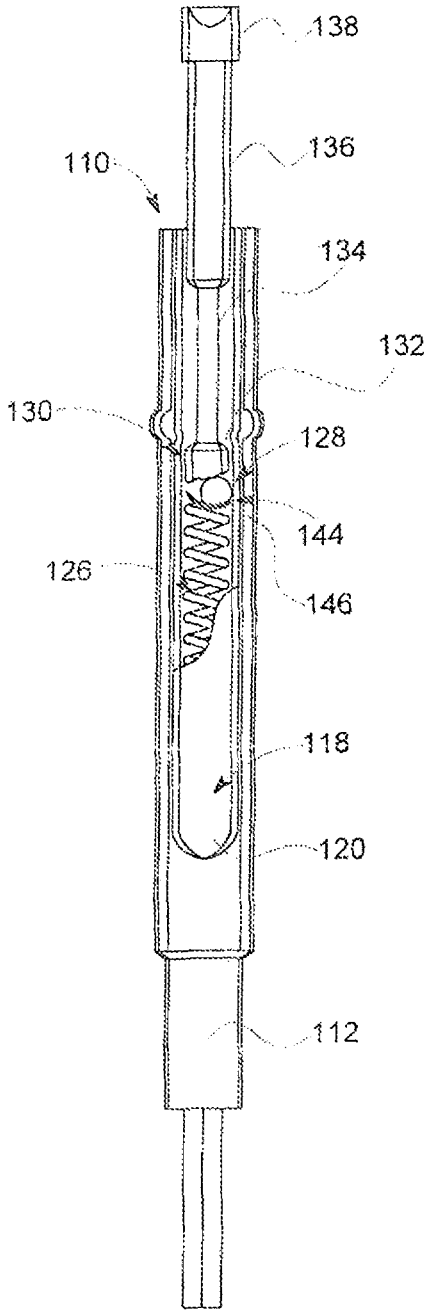

In still another alternative exemplary and non-limiting embodiment illustrated in FIG. 6C, the interface 146 can be disposed on or over the end of the spring 126 disposed in contact with the ball 128. At this location, the interface 146 can be formed with a curved cross-section in order to effectively contact and retain the ball 128 in position with regard to the spring 126. Further, in the embodiments of FIGS. 6B-6C, the placement of the interface 146 provides a block to any current or voltage potentially passing through the spring 126 and/or ball 128, effectively directing or restricting the current or voltage flowing through the pin 110 along the correct current path of FIG. 1A even when the plunger 130 is shifted in position relative to the inner cylinder 118.

Figure 6D:
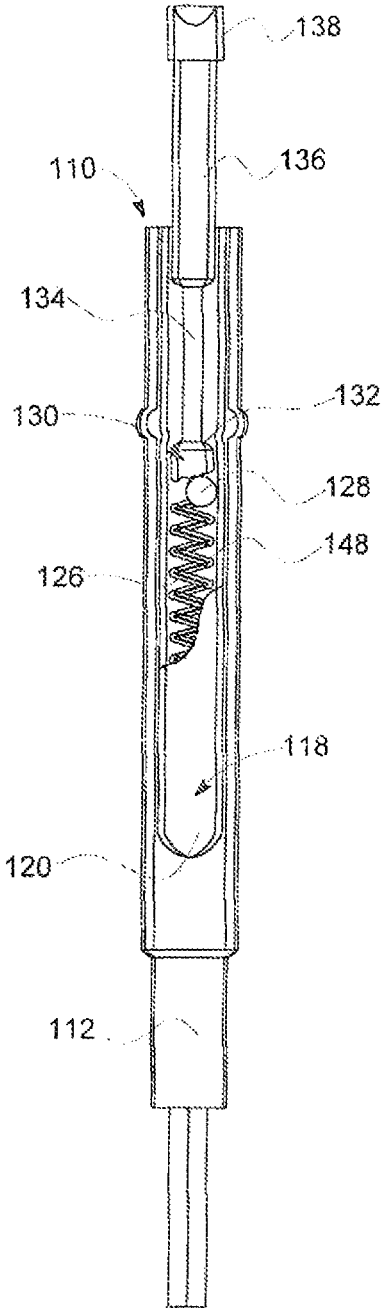

In the illustrated exemplary and non-limiting embodiment of FIG. 6D, a non-conductive coating 148 is applied to one or both of the spring 126 and ball 128, such as a (please provide examples of suitable coating material), among other suitable non-conductive coatings. The formation of the spring 126 and/or ball 128 with a non-conductive coating 148 thereon effectively prevents or restricts current from passing through the spring 126 and/or ball 128, maintaining the correct current or voltage path of FIG. 1A even when the plunger 130 is shifted in position relative to the inner cylinder 118.

Figure 6E:
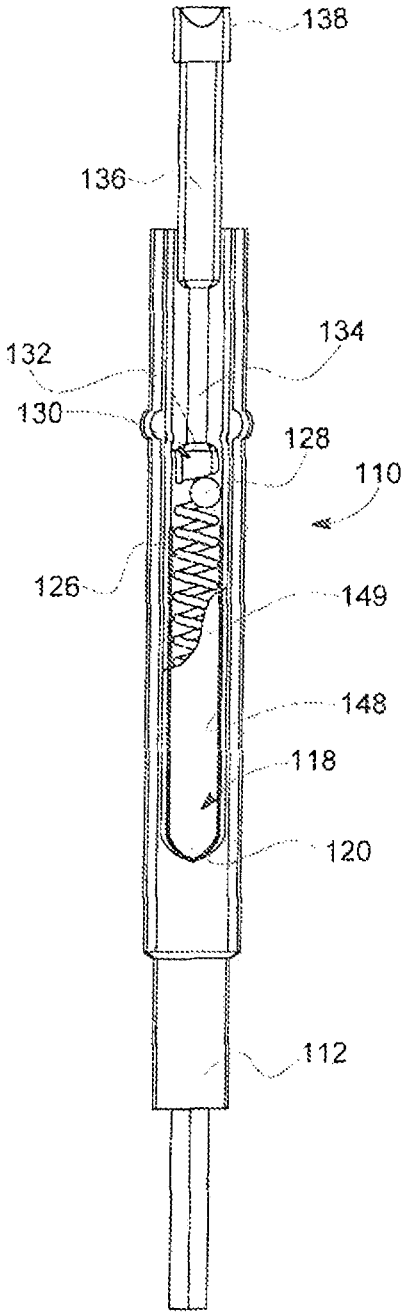

In the illustrated exemplary and non-limiting embodiment of FIG. 6E, the non-conductive coating 148, as previously described, is applied to a portion of the interior surface 149 of the inner cylinder 118. The coating 148 is applied to the interior surface 149 from the closed end 120 of the inner cylinder 118 to a level or height on the interior surface 149 of the inner cylinder 118, such as along the length of the stroke of the head 132 within the inner cylinder 118 that extends the length of the inner cylinder from the bottom of the inner cylinder to the maximum position of the inner cylinder that still allows the full stroke of the plunger which ranges between 1-10 mm, such that the non-conductive coating 148 effectively prevents current from passing through the spring 126 and/or ball 128, maintaining the correct current or voltage path of FIG. 1A even when the plunger 130 is shifted in position relative to the inner cylinder 118. However, the coating 148 is not applied along the entire interior surface 149 of the inner cylinder 148, such that current or voltage is restricted to flow in the correct path of FIG. 1A from the outer cylinder 112 to the inner cylinder 118 and from the inner cylinder 118 to the plunger 130 past the spring 126 and the ball 128.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A connector pin assembly configured to engage an electrical interface, the connector pin assembly comprising:

a conductive outer cylinder configured to be connected to a power supply that supplies current or voltage;

a conductive inner cylinder located at least partially within the outer cylinder;

a biasing member disposed within the inner cylinder;

a conductive plunger slidably disposed within and engaged with the inner cylinder and the biasing member; and a non-conductive member disposed within the inner cylinder, the non-conductive member operable to restrict a current or voltage flowing through the connector pin along a path from the outer cylinder through the inner cylinder to the plunger without contacting the biasing member.

2. The connector pin assembly of claim 1, wherein the non-conductive member is a non-conductive coating.

3. The connector pin assembly of claim 2, wherein the non-conductive coating is applied to at least one of the biasing member and the inner cylinder.

4. The connector pin assembly of claim 1, wherein the non-conductive coating is applied to only a portion of an interior surface of the inner cylinder.

5. The connector pin assembly of claim 1, wherein the connector comprises a faraday enclosure.

6. The connector pin assembly of claim 1 wherein the non-conductive member is positioned between the plunger and biasing member.

7. The connector pin assembly of claim 6 wherein the non-conductive member is secured to the biasing member.

8. The connector pin assembly of claim 7 wherein the non-conductive member has a curved cross-section.

9. The connector pin assembly of claim 6 wherein the non-conductive member is secured to the plunger.

10. The connector pin assembly of claim 1 further comprising a ball disposed between the biasing member and the plunger.

11. The connector pin assembly of claim 10 wherein the ball is formed as the non-conductive member.

12. The connector pin assembly of claim 1 wherein the biasing member is formed as the non-conductive member.

13. A connector device configured to be engaged with a mating assembly of an electrical interface, the connector device comprising:

a housing defining an interior; and a pin housing or pin support region positioned or located within the interior of the housing and comprising a number of connector pins disposed therein and configured to be connected to a power supply, wherein each pin comprises a conductive outer cylinder configured to be connected to the power supply, a conductive inner cylinder located at least partially within the outer cylinder, a biasing member disposed within the inner cylinder, a conductive plunger slidably disposed within and engaged with the inner cylinder and the biasing member, and a non-conductive member disposed within the inner cylinder, the non-conductive member operable to restrict a current or voltage flowing through the connector pin along a path from the outer cylinder through the inner cylinder to the plunger without contacting the biasing member.

14. The connector of claim 13 wherein the non-conductive member is a non-conductive coating.

15. The connector of claim 13 further comprising a ball disposed between the biasing member and the plunger.

16. The connector of claim 15 wherein one or both of the biasing member or the ball is formed as the non-conductive member.

17. The connector of claim 13 wherein the non-conductive member is disposed between the biasing member and the plunger.

18. A method for supplying current or voltage from a connector to a mating assembly of an electrical interface, the method comprising:

providing a connector comprising a housing defining an interior, a pin housing or pin support region positioned within the interior of the housing and comprising a number of connector pins disposed therein and configured to be connected to a power supply, wherein each pin comprises a conductive outer cylinder configured to be connected to the power supply, a conductive inner cylinder located at least partially within the outer cylinder, a biasing member disposed within the inner cylinder, a conductive plunger slidably disposed within and engaged with the inner cylinder and the biasing member, and a non-conductive member disposed within the inner cylinder, the non-conductive member operable to restrict a current or voltage flowing through the connector pin along a path from the outer cylinder through the inner cylinder to the plunger;

connecting the connector to the mating assembly of the electrical interface; and passing a current or voltage through the connector to the mating assembly of the electrical interface to generate an electron path.

19. The method of claim 18, wherein the step of connecting the connector to the mating assembly of the electrical interface comprises pressing the plunger of each connector pin into engagement with a contact point on the mating assembly against the bias of the biasing member.

20. The method of claim 18 whereon the step of passing the current or voltage through the connector comprises passing the current or voltage from the power source through the connector pin to the mating assembly of the electrical interface along a path from the outer cylinder through the inner cylinder to the plunger without contacting the biasing member.

* * * * *